United States Patent [19]

Carena

[11] Patent Number: 4,607,968

[45] Date of Patent: Aug. 26, 1986

[54] PAPER PRESSING DEVICE FOR PRINTING MACHINES

[75] Inventor: Ugo Carena, Ivrea, Italy

[73] Assignee: Ing. C. Olivetti & C., S.p.A., Italy

[21] Appl. No.: 582,776

[22] Filed: Feb. 23, 1984

[30] Foreign Application Priority Data

Mar. 7, 1983 [IT] Italy ..... 67256 A/83

[51] Int. Cl.[4] ..... B41J 13/054

[52] U.S. Cl. ..... 400/637.2; 400/637

[58] Field of Search ..... 400/636, 637, 637.2, 400/637.6

[56] References Cited

U.S. PATENT DOCUMENTS

| | | | |
|---|---|---|---|
| 1,145,017 | 7/1915 | Hess | 400/637.6 X |
| 1,185,318 | 5/1916 | Hess | 400/637 X |
| 2,848,092 | 8/1958 | Ostholm et al. | 400/637.2 X |
| 3,267,850 | 8/1966 | Ryan et al. | 101/232 |
| 4,469,454 | 9/1984 | Crean | 400/637.2 X |

FOREIGN PATENT DOCUMENTS

| | | | |
|---|---|---|---|
| 962253 | 6/1950 | France | 400/637.2 |
| 89160 | 11/1957 | Netherlands | 400/637.2 |
| 235299 | 11/1940 | Switzerland | 400/637.2 |
| 864975 | 4/1961 | United Kingdom | 400/636 |

OTHER PUBLICATIONS

IBM Technical Disclosure Bulletin, by Ramirez et al., "Platen Backup Rollers", vol. 25, No. 1, Jun. 1982, pp. 202–203.

*Primary Examiner*—Edgar S. Burr
*Assistant Examiner*—John A. Weresh
*Attorney, Agent, or Firm*—Banner, Birch, McKie & Beckett

[57] ABSTRACT

The device comprises two or more cover plate members (14), whose lengths are submultiples of the lengths of a range of platen rollers (12) and such that two or more plate members disposed in side-by-side relationship cover the entire length of the platen roller. Each plate member (14) comprises a lower guide portion (16) of part-cylindrical shape and two wall portions (17, 18) which are substantially planar and set at different angles of inclination, being connected to the lower guide portion in such a way to lead in a sheet of paper (19) towards the guide portion. Each plate member (14) is pivotally mounted on a control shaft (22) which is parallel to the axis of the roller (12) and capable of preventing transverse movements of the plate member with respect to the roller, and carries the usual paper pressing rollers (34, 36) which are disposed in two parallel rows. A leaf spring (26) co-operates with a lug (24) on the plate member (14) to hold the paper pressing rollers pressed against the platen roller. The control shaft comprises opening cams (57) arranged to co-operate with the leaf springs to disengage same from the respective lugs and to permit the respective plate members to drop away from the platen roller (12), whereby the paper pressing rollers (34, 36) are disengaged from the platen roller to assist in introducing the sheet of paper.

8 Claims, 3 Drawing Figures

PAPER PRESSING DEVICE FOR PRINTING MACHINES

The present invention relates to a paper pressing device for printing machines with a platen roller, comprising a paper pressing plate member for guiding a sheet of paper round the platen roller towards the printing line and paper pressing rollers for holding the sheet of paper closely against the platen roller. Normally, the paper pressing plate member comprises a lower guide portion which is disposed below the platen roller. This portion is of part-cylindrical shape and has at least two series of paper pressing rollers which are housed and fixed in the lower guide portion. Because the platen rollers are of different lengths, a series of guide portions of different lengths must correspond to each series of platen rollers. With such a system, the overall cost is rather high.

The object of the present invention is to provide a device with a paper pressing plate member which is simple, reliable, easy to use and of moderate cost. The paper pressing device according to the invention is characterised by the characterising portion of claim 1.

Figure 1:
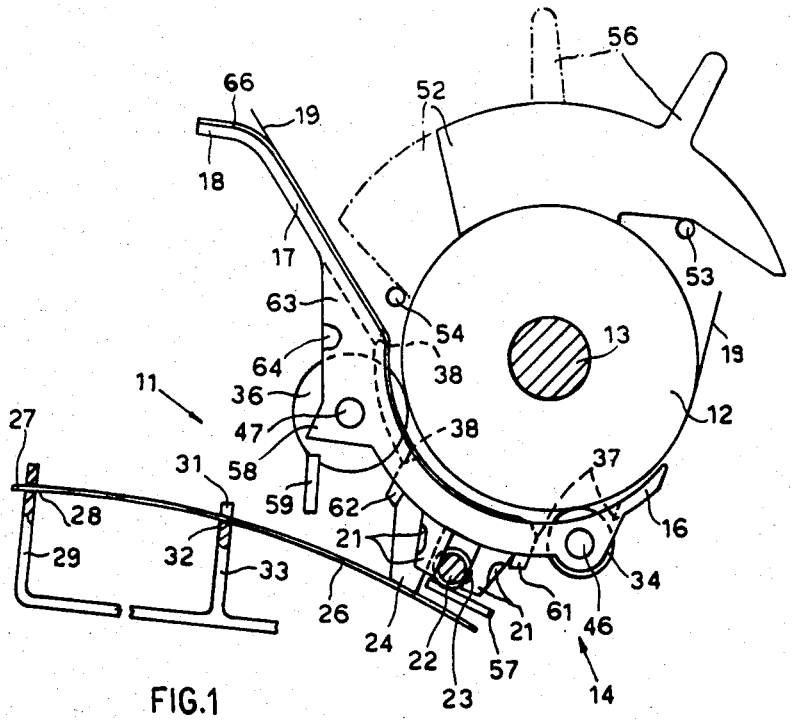
Figure 2:
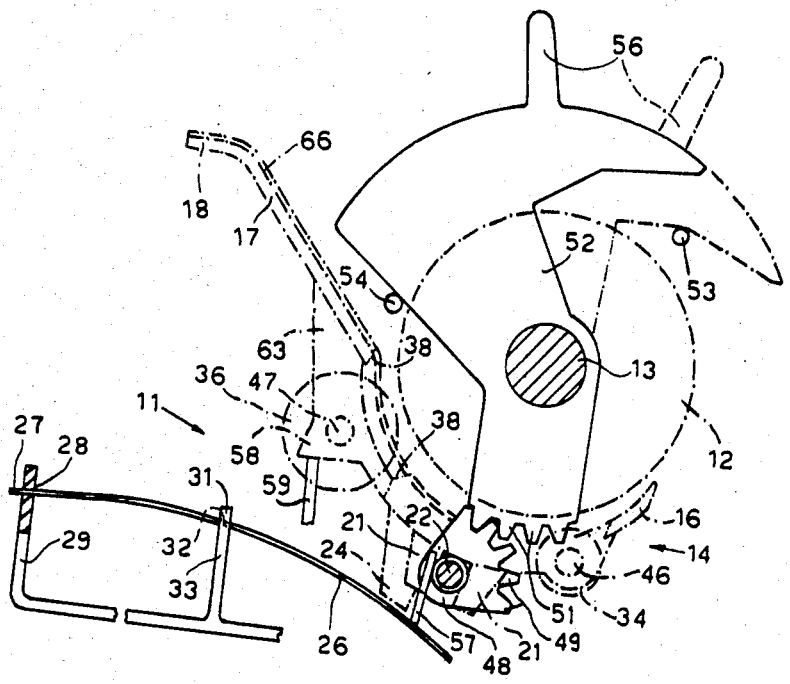
Figure 3:
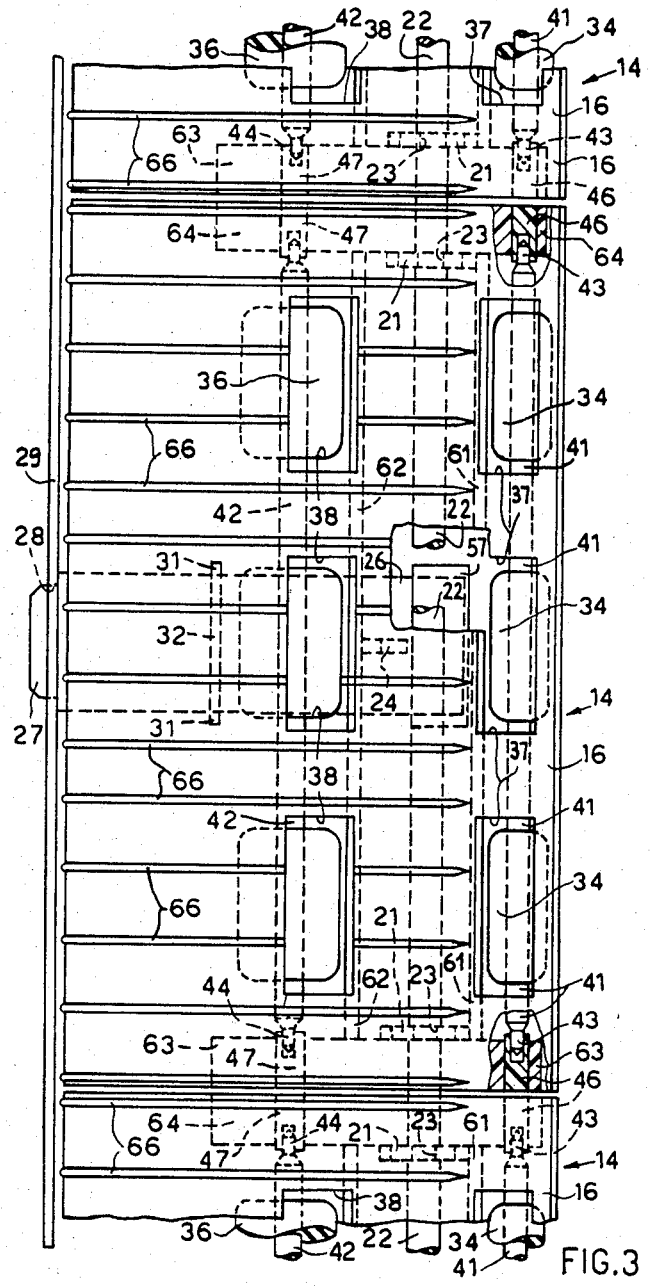

A preferred embodiment of the invention is set forth in the following description which is given by way of non-limiting example and with reference to the accompanying drawings in which:

FIG. 1 is an end view of part of the device embodying the invention, in an operating position, FIG. 2 is a like view of the device in a second position, and FIG. 3 is a plan view of part of the device of FIG. 1 on a different scale from FIGS. 1 and 2.

The paper pressing device is designed to be applied to a typewriter, accounting machine, terminal or similar printing machine. In the embodiment described hereinafter, the paper pressing device 11 (see FIG. 1) is applied to a typewriter of electronic type having a conventional platen roller 12 which is rotatable with a shaft 13 by means of an electric motor of a line spacing arrangement which is not shown in the drawings but which may be like that described in our published application No. EPO 038 216.

The device 11 comprises a modular plate member 14 which is shaped like a pantile with a lower guide portion 16 of part-cylindrical shape, a substantially planar wall portion 17 which is inclined at an angle of 45° with respect to the horizontal plane of the machine and which leads into the top edge of the guide portion 16, and a second wall portion 18 which is also substantially planar and which is inclined with respect to the first wall portion such as to lie in a virtually horizontal plane, forming thereby an out-turned flange on the first wall portion 17.

The first wall portion 17 extends above the platen roller 12 and, together with the second wall portion 18, forms a guide-in means for guiding and conveying a sheet of paper 19 towards the lower guide portion 16.

The plate member 14 is pivotally mounted by means of two forks 21 on a control shaft 22 which is parallel to the shaft 13 of the platen roller 12. Each fork 21 is engaged in a corresponding groove 23 in the shaft 22. The engagement of the forks 21 with the grooves 23 prevents transverse movements of the member 14 with respect to the platen roller 12. The member 14 comprises a lug 24 capable of co-operating with a leaf spring 26 which is engaged at the rear end 27 in a slot 28 in a support 29 and is guided laterally between two projections 31 (see FIG. 3) of a support 33 (see FIG. 1). The spring bears on the edge 32 of the support so that the front end of the spring, acting on the lug 24, urges the member 14 constantly towards and parallel to the platen roller 12. In addition, the member 14 is held in an arrested position, by means of front and rear paper pressing rollers 34 and 36 respectively, against the outside surface of the platen roller 12.

The front and rear pressing rollers 34 and 36 are housed in suitable seats 37 and 38 in the lower guide portion 16 and are mounted on rotatable shafts 41, 42 (see FIG. 3), having ends 43 and 44 journalled in bushes 46 and 47 on the guide portion 16. The shafts 41 and 42 are held parallel to the shaft 13 (see FIG. 1) of the platen roller 12.

The control shaft 22 is carried on the machine in such a way as to oscillate about is axis parallel to the platen roller 12, and is connected at one end to an actuating sector member 48 (see FIG. 2) which has teeth 49 by which it is engaged with teeth 51 on a platen opening lever 52. The lever 52 is pivotally mounted on the shaft 13 and is movable by means of a handle 56 between two positions which are defined by fixed abutments 53 and 54. The control shaft 22 carries opening cams 57 which are formed by rectangular blades which are fixed to the shaft 22 and are lined up with the blade springs 26, being arranged to co-operate with the blades springs to disengage the springs 26 from the lugs 24 and permit the member 14 to move radially away from the platen roller 12. In that way, the front and rear rollers 34 and 36 are disengaged from the platen roller 12 and the member 14 moves downwardly under the force of gravity until it is stopped by means of a shoulder 58 against a fixed abutment 59 of the machine and with the bottom of the forks 21 against the shaft 22, to make it easier to insert the sheet of paper 19 (see FIG. 2).

The member 14 is of plastics material and comprises two longitudinal ribs 61 and 62 disposed on the underside thereof and over the entire length of the conveyor portion 16, and two laterial ribs 63 and 64, such as to prevent any deformation of the member 14. In addition, the member 14 is provided on its upper surface with a series of ribs 66 (see FIG. 3) which are disposed parallel to each other in planes perpendicular to the platen roller 12 and arranged to limit the area of contact between the sheet of paper 19 (see FIG. 1) and the member 14. Since the platen rollers 12 are of various predetermined lengths, the length of the member 14 is an integral submultiple of the predetermined lengths, in such a way that the sum of the lengths of two or more plate members 14 corresponds to the specific lengths of the various platen rollers 12.

Normally, the roller opening lever 52 is in the position in which it is blocked against the fixed abutments 53 and thus the blade 57 is disengaged from the spring 26. The spring 26 is in turn engaged with the lug 24, thereby holding the member 14 in the position shown in FIG. 1 with the front and rear rollers 34 and 36 bearing against the roller 12. If the operator wishes to insert a sheet of paper 19, he or she pushes back the handle 56, causing the lever 52 to rotate in the anticlockwise direction. By means of the teeth 49, 51 (see FIG. 2), this causes the sector member 48 with the shaft 22 to rotate in the clockwise direction. During that rotary movement, the blade 57 engages the blade spring 26, causing it to flex down and disengaging it from the lug 24. Due to the force of gravity, the member 14 drops down in FIG. 2 until the shoulder 58 bears against the abutment 59 and the bottom of the fork 21 bears against the shaft 22. The rollers 34 and 36 are thus spaced from the platen roller 12. By moving the lever 52 back again, the sector member 48 rotates in the anticlockwise direction whereby the blade 57 is disengaged from the leaf spring 26 which engages the lug 24, raising the member 14 until it comes into a position of abutment with the paper rollers 34 and 36 pressed against the platen roller 12.

It will be apparent that the member 14, being guided on the shaft 22, remains substantially parallel to the platen roller 12 and the force of the leaf spring 26 acting on the lug 24 causes the pressure of the member 14 against the platen roller 12 to be equally distributed among the front and rear paper rollers 34 and 36.

I claim:

1. A paper pressing device for a printing machine of the type comprising:

a platen roller which defines a line of printing;

a control shaft which is disposed below, parallel and on the entire length of the platen roller and comprises a series of grooves;

loading elements;

a fixed abutment member; wherein the paper pressing device guides a sheet of paper towards the line of printing and comprises:

a modular plate member having: a lower guide portion of part cylindrical shape, a substantially planar portion which is inclined with respect to the horizontal plane and extends above the platen roller; two lateral ribs, each having two bushings; and two forks, wherein each fork is connected with a corresponding lateral rib, and is slidably guided by a corresponding groove in the control shaft and wherein the engagement of the forks with the series of grooves prevents axial movements of the modular plate member with respect to the platen roller; a frontal rotatable shaft and a rear rotatable shaft, both journaled on the bushings of the lateral ribs of said modular plate member parallel therebetween and parallel to the platen roller; and wherein said modular plate member further comprises a series of frontal pressing rollers, mounted on said frontal shaft, a series of tear pressing rollers, mounted on said rear shaft, a shoulder disposed adjacent to the rear rotatable shaft, an intermediate element disposed between the two forks and projecting from the lower guide portion, and two longitudinal ribs connected with the two lateral ribs, the two lateral ribs, the two forks and the intermediate element;

spring means disposed below the modular plate member comprising a leaf spring having a free end and an intermediate portion, wherein the loading elements engage said intermediate portion to load the leaf spring in order to cause said free end to engage with said intermediate element to urge the modular plate member towards the platen roller parallel thereto with the frontal pressing rollers and the rear pressing rollers pressing against the outside surface of the platen roller; and cam means mounted on the control shaft and arranged to cooperate with said free ends to disengage the free end from the intermediate element in order to cause the modular plate member to move radially away from the plate roller, and the frontal pressing rollers and the rear pressing rollers to disengage the platen roller, wherein the modular plate member moves downwardly under the force of gravity unit it is stopped by means of the shoulder against said fixed abutment member and with the bottom of the forks arrested against the outside surfaces of the grooves of the control shaft so that the modular plate member is positioned inclined with the planar portion away from the platen roller to make it easier to insert a sheet of paper.

2. A paper pressing device according to claim 1, wherein said two forks are disposed between the frontal pressing rollers and the rear pressing rollers, wherein the intermediate element comprises a lug which is disposed in a centered position with respect to the two forks and wherein the free end of the leaf spring acts on said lug.

3. A paper pressing device according to claim 1, wherein the modular plate member comprises a series of slide ribs disposed on the surface which is towards the platen roller, said series of slide ribs are parallel therebetween and are disposed in planes perpendicular to the platen roller and limit the area of contact between the sheet of paper and the surface of the modular plate member.

4. A paper pressing device according to claim 1, wherein the platen rollers are of various predetermined lengths and the length of the modular plate member is an integral sub-multiple of the predetermined lengths in such a way that the sum of the lengths of two or more modular plate members corresponds to the specific lengths of the various platen rollers.

5. A paper feeding and guiding device for a printing machine of the type comprising:

a platen roller defining a line of printing;

a single control shaft member which is disposed below and on the entire length of the platen roller, can oscillate about its axis parallel to the platen roller and comprises a plurality of pairs of grooves;

a plurality of modular plate members each made of plastic material and comprising: a lower guide portion of part cylindrical shape and a substantially planar portion extending upwardly and rearwardly with respect to the lower guide portion for guiding a sheet of paper towards the line of printing; a pair of forks disposed at the ends of each modular plate member and extending downwardly from said lower guide portion for causing the plate members to be respectively slidably guided by a corresponding one of said plurality of pairs of grooves, in the control shaft, wherein the engagement of the forks with the grooves prevents axial movements of the modular plate members with respect to the platen roller; two longitudinal ribs disposed on the underside of each modular plate member and over its entire length; two series of seats disposed adjacent to the longitudinal ribs; two lateral ribs connected to the ends of the longitudinal ribs and each comprising a single shoulder adjacent to the rear support and two bushings; and an intermediate lug extending downwardly and adjacent to one longitudinal rib and in a centered position with respect to said lateral ribs;

a plurality of pairs of shafts each pair supported frontally and rearwardly by a modular plate, wherein each shaft has its ends journaled in said two bushings of each modular plate member, parallel to the platen roller;

front and rear pressing rollers housed in the two series of seats of each modular plate member and mounted on said rotatable shafts;

spring means comprising a plurality of leaf springs each having an end engaged with a support, an intermediate portion laterally guided by a pair of guides disposed below said modular plate member and a front end portion cooperating with the intermediate lug of said modular plate member to urge the modular plate member towards the platen roller parallel thereto in order to hold the modular plate member in an arrested position by means of the front and rear pressing rollers which bear against the outside surface of the platen roller;

a fixed abutment parallel to said control shaft; and cam means mounted on the control shaft member and arranged to cooperate with the front end of the leaf spring to disengage the leaf spring from the intermediate lug in order to cause the modular plate members to move radially away from the platen roller and the front and rear pressing rollers to be disengaged from the platen roller whereby enabling the modular plate member to be moved downwardly under the force of gravity and to pivot on said support shaft rearwardly until it is stopped by means of the shoulder against the fixed abutment and with the bottom of the pair of forks arrested against the outside surface of the plurality of pairs of grooves of said control shaft member to make it easier to insert the sheet of paper.

6. A paper feeding and guiding device according to claim 5, wherein said substantially planar wall portion extends upwardly and rearwardly with respect to said lower guide portion, which is inclined at an angle of 45° with respect to the horizontal plane and which leads into the top edge of the lower guide portion and comprises a wall portion which is also substantially planar and which is inclined with respect to the substantially planar portion such as to lie in a virtually horizontal plane, forming thereby an out-turned flange on the substantially planar portion which extends above the platen roller and together with the wall portion form a guide-in means.

7. A paper feeding and guide device according to claim 6, wherein the upper surfaces of the lower guide portion, planar portion and wall portion comprise a series of slide ribs which are parallel to each other and which are disposed in planes perpendicular to the platen roller axis, to limit the area of contact between the sheet of paper and the modular plate member, wherein said modular plate member has a length that is an integral sub-multiple of the length of the platen roller, wherein the control shaft member comprises at one end an actuating sector having teeth, wherein a pivotally mounted lever is movable between an arrest position in which the modular plate member is arrested with the front and rear pressing rollers against the outside surface of the platen roller and an open position in which the modular plate member is away with the front and rear pressing rollers from the outside surface of the platen roller, wherein said pivotally mounted lever comprises teeth which are engaged with the teeth of the actuating sector, wherein said pivotally mounted lever actuates said cam means through the control shaft member, and wherein the cam means comprise a blade which cooperates with the front end of the leaf spring.

8. A paper feeding and guiding device according to claim 5, wherein said platen roller has a rotational axis and further comprising a first toothed sector fixed at one end of said first toothed sector fixed at one end of said control shaft and a second toothed sector engaged with said first toothed sector for its rotation, wherein said cam means operate on the free end of said leaf springs upon rotation of said central shaft and wherein said second toothed sector is provided on said rotational axis and is provided with a command lever for its operation.

* * * * *